US010236575B2

(12) United States Patent
Lundstedt et al.

(10) Patent No.: US 10,236,575 B2
(45) Date of Patent: Mar. 19, 2019

(54) ANTENNA SYSTEM EMPLOYING A ROTATABLE CIRCULARLY POLARIZED ANTENNA FEED

(71) Applicant: Hughes Network Systems, LLC, Germantown, MD (US)

(72) Inventors: Jack Lundstedt, Monrovia, MD (US); Peter Hou, Clarksburg, MD (US); David Farrow, Gaithersburg, MD (US); Ramesh Kollipara, Clarksburg, MD (US)

(73) Assignee: HUGHES NETWORK SYSTEMS, LLC, Germantown, MD (US)

( * ) Notice: Subject to any disclaimer, the term of this patent is extended or adjusted under 35 U.S.C. 154(b) by 448 days.

(21) Appl. No.: 14/995,849

(22) Filed: Jan. 14, 2016

(65) Prior Publication Data

US 2017/0207528 A1 Jul. 20, 2017

(51) Int. Cl.

| | |
|---|---|
| ***H01Q 19/00*** | (2006.01) |
| ***H01Q 3/18*** | (2006.01) |
| ***H01Q 15/16*** | (2006.01) |
| ***H01Q 15/24*** | (2006.01) |
| ***H01Q 19/13*** | (2006.01) |
| ***H01Q 19/19*** | (2006.01) |

(52) U.S. Cl.

CPC ..... *H01Q 3/18* (2013.01); *H01Q 15/16* (2013.01); *H01Q 15/24* (2013.01); *H01Q 19/13* (2013.01); *H01Q 19/19* (2013.01)

(58) Field of Classification Search

CPC ..... H01Q 1/35; H01Q 15/16; H01Q 15/24; H01Q 19/13; H01Q 19/19

See application file for complete search history.

(56) References Cited

U.S. PATENT DOCUMENTS

| | | | | |
|---|---|---|---|---|
| 2014/0057576 | A1* | 2/2014 | Monte | H01Q 3/02 455/73 |
| 2016/0056537 | A1* | 2/2016 | Guler | H01Q 3/01 343/762 |
| 2016/0226150 | A1* | 8/2016 | Paleta, Jr. | H01Q 19/19 |

* cited by examiner

*Primary Examiner* — Dieu Hien T Duong

(74) *Attorney, Agent, or Firm* — Global IP Counselors, LLP

(57) ABSTRACT

An antenna system comprises an antenna feed support and a driver. The antenna feed support is configured to mount a circularly polarized antenna feed to an antenna dish to extend outward along a longitudinal axis of the circularly polarized antenna feed with respect to a reflective surface of the antenna dish. The driver is configured to rotate the circularly polarized antenna feed to adjust alignment between the circularly polarized antenna feed and a remote antenna. The driver can rotate the circularly polarized antenna feed mechanically, electrically or both to adjust alignment between the circularly polarized antenna feed and a remote antenna to reduce cross-pol discrimination at the circularly polarized antenna feed.

20 Claims, 5 Drawing Sheets

ANTENNA SYSTEM EMPLOYING A ROTATABLE CIRCULARLY POLARIZED ANTENNA FEED

BACKGROUND

Field of the Invention

The present invention generally relates to an antenna system and method for installing an antenna system. More particularly, the present invention relates to an antenna system employing a rotatable antenna feed, in particular, a rotatable circularly polarized antenna feed, and a method for installing and operating such an antenna system.

Background Information

As understood in the art, satellite communication systems include a plurality of terrestrially mounted gateways that communicate with one or more orbiting satellites. Each satellite gateway includes an antenna dish, an antenna feed and other types of equipment such a transceiver, amplifiers, waveguides and so on which enable communication between the satellite gateway and one or more of the orbiting satellites. The satellite gateway and a satellite typically communicate with each other over a radio frequency link, such as a Ku-band link, a Ka-band link or any other suitable type of link. For example, the Ku-band is a portion of the electromagnetic spectrum in the microwave range of frequencies ranging from 10 GHz to 18 GHz, and the Ka band is a portion of the electromagnetic spectrum in the microwave range of frequencies ranging from 17 GHz to 40 GHz.

During installation of a gateway, the gateway antenna dish is oriented to align the gateway antenna feed with an antenna feed on an orbiting satellite. Often, the gateway antenna feed and the orbiting antenna feeds are circularly polarized antenna feeds. However, since the polarization of these antenna feeds at the gateway and the orbiting satellite are not perfectly circular and have some elliptical characteristics, the antenna feeds at the gateway and the orbiting satellite often will not be perfectly aligned with each other. This misalignment causes some loss to be present in the communication link between the gateway and orbiting satellite.

SUMMARY

In order to attempt to better align the gateway and satellite antenna dishes, it is possible to rotate either or both of the gateway and satellite antenna dishes to attempt to better align the antenna feeds. However, because an antenna dish at the gateway is typically 5 to 8 meters in diameter, these types of antenna dishes are generally difficult to rotate.

In view of these drawbacks of the state of the known technology, one aspect of the present invention provides a gateway antenna dish arrangement in which the antenna feed is rotatably coupled to the antenna dish so that the antenna feed can be rotated without rotating the entire antenna dish. Thus, an embodiment of the present invention provides an antenna system that comprises an antenna feed support and a driver. The antenna feed support is configured to mount a circularly polarized antenna feed to an antenna dish to extend outward along a longitudinal axis of the circularly polarized antenna feed with respect to a reflective surface of the antenna dish. The driver is configured to rotate the circularly polarized antenna feed to adjust alignment between the circularly polarized antenna feed and a remote antenna. The driver can rotate the circularly polarized antenna feed mechanically, electrically or both to adjust alignment between the circularly polarized antenna feed and a remote antenna to reduce cross-pol discrimination (XPD) at the circularly polarized antenna feed.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
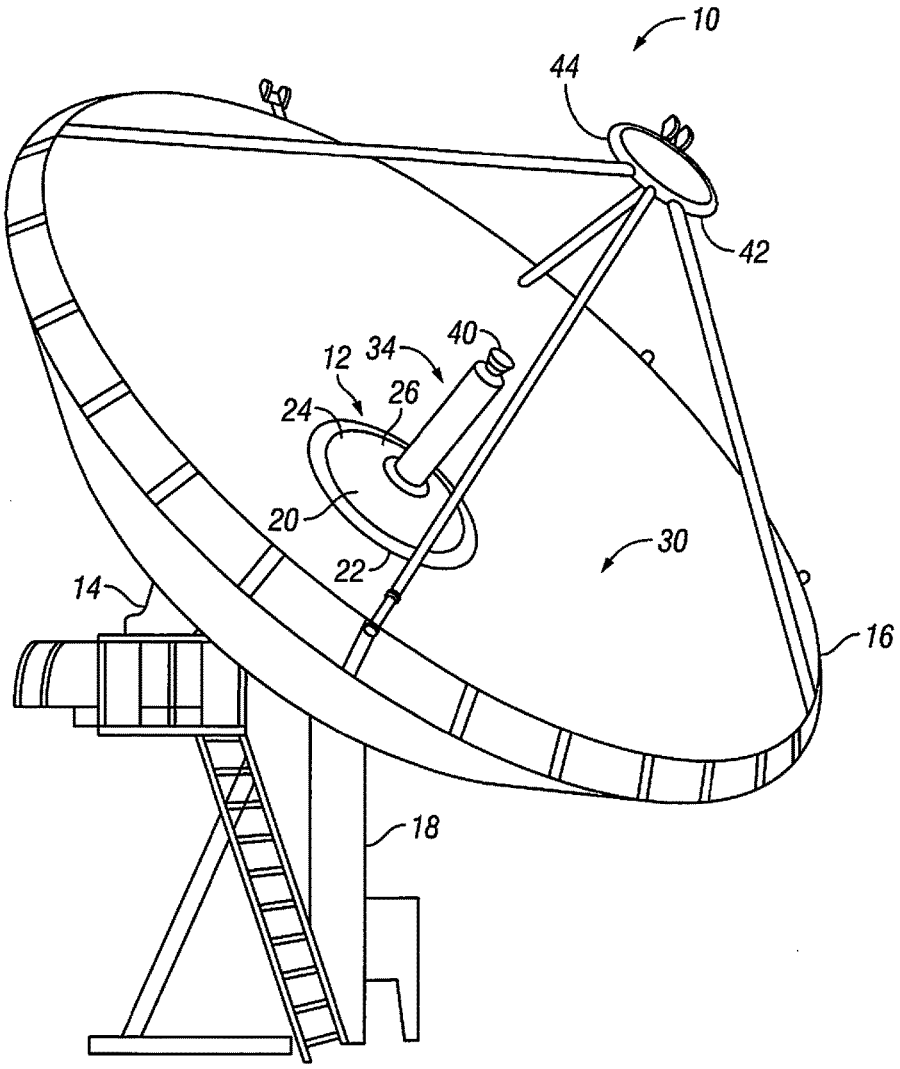
FIG. 1 illustrates an example of a satellite communication gateway employing a rotatable antenna feed according to a disclosed embodiment.

FIG. 1 illustrates an example of a gateway antenna 10 for use in a satellite communication network. The gateway antenna 10 is installed terrestrially at a desired location on the Earth, and includes an antenna system 12 and a gateway antenna equipment room 14. In this example, the antenna system 12 includes an antenna dish 16 that is pivotally mounted to a terrestrially mounted antenna dish base 18 in any conventional manner as understood in the art. Thus, the antenna dish 16 can be manually or automatically pointed in azimuth and elevation to align the antenna dish 16 with an antenna dish of an orbiting satellite (not shown) in any conventional manner as understood in the art. However, although for exemplary purposes the embodiments disclosed herein are described with respectfully a terrestrially mounted antenna dish, the embodiments can be employed in any suitable type of antenna dish configuration, such as an antenna dish configuration on a moving satellite or any other type of moving body.

As shown in more detail in FIGS. 2 through 5, the antenna system 12 according to a disclosed embodiment includes an antenna feed support 20 that is configured to mount to the antenna dish 16. In this example, the antenna feed support 20 comprises a stationary support 22 that is fixedly mount with respect to the antenna dish 16 in any suitable manner. That is, the stationary support 22 can be directly mounted to the antenna dish 16 by any suitable type of fastening mechanisms such as bolts, welding and so on. Alternatively, the stationary support 22 can be mounted to another type of support (not shown) so as to be positioned in a fixed manner with respect to the antenna dish 16, and be capable of moving in unison with the antenna dish 12, without necessarily being directly connected to the antenna dish 16.

The antenna feed support 20 further comprises a rotatable support 24 that is rotatably mounted to the stationary support 22 in any suitable manner as understood in the art. The rotatable support 24 includes a first surface 26 and a second surface 28 opposite to the first surface 26. The rotatable support 24 is rotatably mounted to the stationary support 22 to position the first surface 26 to face outward from a reflective surface 30 of the antenna dish 16. The rotatable support 24 can be rotated a full 360 degrees either clockwise or counter-clockwise as necessary, and is typically rotated up to 90 degrees in the clockwise or counter-clockwise directions.

As further illustrated, the first surface 26 includes an antenna feed mounting structure 32 configured to mount an antenna feed 34 to the rotatable support 24. In this embodiment, the antenna feed 34 is a circularly polarized antenna feed, such as a Ka-band antenna feed. However, the antenna feed 34 can be any type of circularly polarized antenna feed, or any other type of antenna feed such as a Ku-band antenna feed or other type of commercial or military band antenna feed. The antenna feed mounting structure 32 mounts the circularly polarized antenna feed 34 to extend outward along a longitudinal axis L of the circularly polarized antenna feed 34 with respect to the reflective surface 30 of the antenna dish 16. As understood in the art and as shown schematically in FIG. 5, the circularly polarized antenna feed 34 can include an orthomode transducer (OMT) 36, a polarizer 38 and a feed horn 40. As understood in the art, the circularly polarized antenna feed 34 is circularly polarized by the polarizer 38 or in any other suitable manner. The polarizer 38 of the circularly polarized antenna feed 34 can be round or substantially round, but as a practical matter has at least a slight elliptical shape as understood in the art. In this example, the orthomode transducer 36 is mounted closest to the first surface 26 of the rotatable support 24 and the feed horn 40 is furthest away from the first surface 26. The antenna feed mounting structure 32 mounts the circularly polarized antenna feed 34 to the first surface 26 of the rotatable support 24 using any suitable type of fasteners such as bolts, screws and so on as understood in the art. Naturally, one end of the circularly polarized antenna feed 34 can be configured with a male or female threaded end, and the antenna feed mounting structure 32 can be configured with a male or female threaded end opposite to that of the circularly polarized antenna feed 34 so that the circularly polarized antenna feed 34 can screwably mount to the antenna feed mounting structure 32.

As further shown, the antenna system 12 includes a subreflector 42 that is mounted to the antenna dish 16 in any suitable manner as known in the art. Therefore, signals being emitted from the feed horn 40 reflect off of a reflective surface 44 of the subreflector 42 toward the reflective surface 30 of the antenna dish 16, and then off of the reflective surface 30 toward the distant antenna dish on, for example, an orbiting satellite (not shown) as understood in the art. Similarly, signals being emitted from, for example, the orbiting satellite toward the gateway antenna 10 are reflected off of the reflective surface 30 toward the reflective surface 44 of the subreflector 42, and are reflected off of the reflective surface 44 into the feed horn as understood in the art. The antenna dish 16, as well as the subreflector 42, can be round or substantially round, but as a practical matter can have an elliptical shape or other slightly out of round shape as understood in the art.

Figure 2:
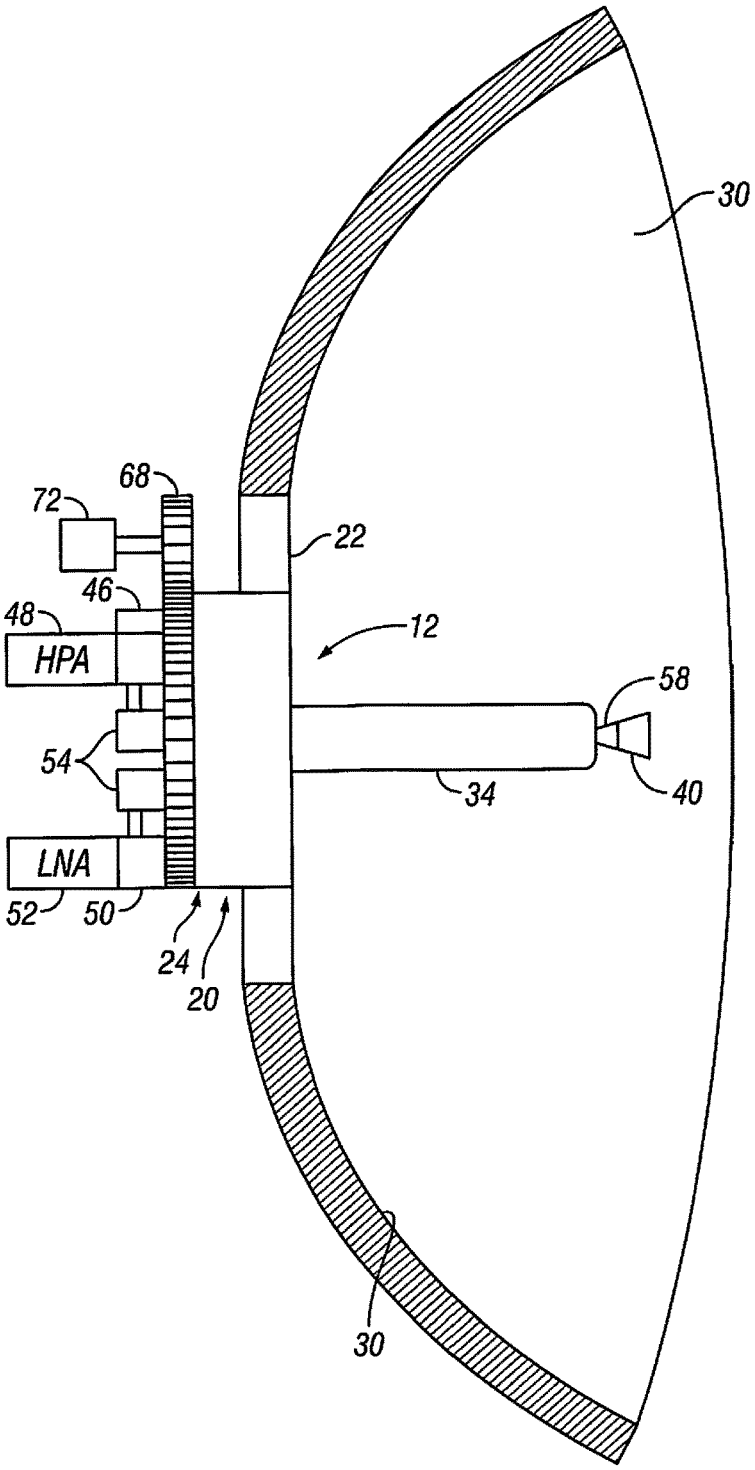
FIG. 2 is a cross-sectional view of the antenna dish of the satellite communication gateway shown in FIG. 1 including a rotatable antenna feed structure.
Figure 3:
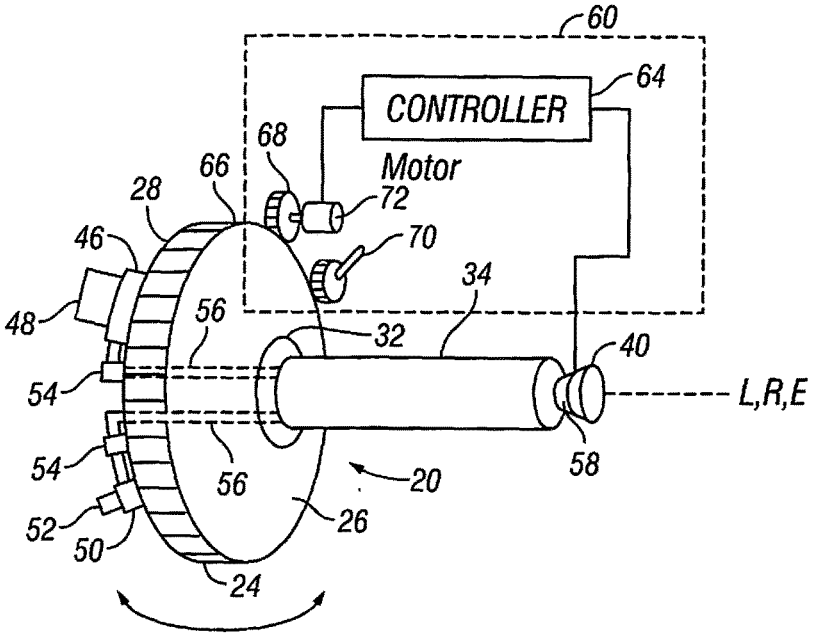
FIG. 3 is a diagram illustrating further details of an exemplary rotatable antenna feed structure as shown in FIGS. 1 and 2.

As further illustrated in FIGS. 2 and 3, the second surface 28 of the rotatable support 24 has a high powered amplifier mounting structure 46 configured to mount a high powered amplifier 48 to the rotatable support 24 and fixed with respect to the circularly polarized antenna feed 34 using any suitable type of fasteners such as bolts, screws and so on as understood in the art. Thus, the high powered amplifier mounting structure 46 mounts the high powered amplifier 48 immovably or substantially immovably with respect to the circularly polarized antenna feed 34. The second surface 28 can further include a plurality of high powered amplifier mounting structures 46 to mount a plurality of high powered amplifiers 48 to the rotatable support 24. As understood in the art, the rotatable support 24 and high powered amplifier mounting structures 46 are of sufficient strength to support the heavy weight of the high powered amplifiers 48 while also permitting the rotatable support 24 to rotate as discussed herein.

In addition, the second surface 28 can include one or more low noise amplifier mounting structures 50 configured to mount one or more low noise amplifiers 52 to the rotatable support 24 and fixed with respect to the circularly polarized antenna feed 34 using any suitable type of fasteners such as bolts, screws and so on as understood in the art. Thus, the low noise amplifier mounting structures 50 mount the low noise amplifiers 52 immovably or substantially immovably with respect to the circularly polarized antenna feed 34. The second surface 28, the first surface 26, or both, of the rotatable support 24 further include at least one waveguide mounting structure 54 configured to mount a non-flexible waveguide 56 to couple between the circularly polarized antenna feed 34 and one or more of the high powered amplifiers 48 such that the non-flexible waveguide 56 remains undeformed or substantially undeformed as the rotatable support 24 is rotate with respect to the stationary support 22. Naturally, the one or more of the waveguide mounting structures 54 can be configured to mount a non-flexible waveguide 56 to couple between the circularly polarized antenna feed 34 and one or more of the low noise amplifiers 52 such that the non-flexible waveguide 56 remains undeformed as the rotatable support 24 is rotate with respect to the stationary support 22. The one or more waveguide mounting structures 54 can also be configured to mount flexible waveguides (not shown in FIG. 3) between, for example, the circularly polarized antenna feed 34, the high powered amplifiers 48, the low noise amplifiers 52 and any other components as understood in the art. Thus, these arrangements minimize loss between the high powered amplifiers 48, low noise amplifiers 52 and circularly polarized antenna feed 34 since the high powered amplifiers 48 and low noise amplifiers 52 can be mounted to very close to the circularly polarized antenna feed 34 and each other, thereby minimizing the amount of waveguide 56 needed.

In addition, the antenna system 12 can further include a steerable antenna array 58 mounted to the circularly polarized antenna feed 34 in a manner as understood in the art. For instance, the steerable antenna array 58 can be configured in or proximate to the feed horn 40.

As further shown, the antenna system 12 further includes a driver 60. As discussed in more detail below, the driver 60 can be configured to include a mechanical driver 62 that is configured to rotate the circularly polarized antenna feed 34 about the rotation axis R that extends substantially parallel to the longitudinal axis L of the circularly polarized antenna feed 34 while maintaining the circularly polarized antenna feed 34 and the high powered amplifiers 48 fixed with respect to each other. The rotation axis R can coincide with or substantially coincide with the longitudinal axis L of the circularly polarized antenna feed 34.

The driver 60 can also be configured to include an electrical driver such as a controller 64 that configured to control the steerable antenna array 58 to electrically steer the circularly polarized antenna feed about an electrical rotation axis E while maintaining the circularly polarized antenna feed 34 and the high powered amplifiers 48 fixed with respect to each other. The electrical rotation axis E can coincide with or substantially coincide with the rotation axis R, the longitudinal axis L, or both when the rotation axis R coincides with the longitudinal axis L. Naturally, the driver 60 can include both the mechanical driver 62 and the controller 64 which can act as an electrical driver. Also, as understood in the art, the controller 64 preferably includes a microcomputer with a control program that controls the antenna system 12 as discussed herein. The controller 64 can also include other conventional components such as an input interface circuit, an output interface circuit, and storage devices such as a ROM (Read Only Memory) device and a RAM (Random Access Memory) device. The RAM and ROM store processing results and control programs that are run by the controller 64. The controller 64 is operatively coupled to the components of the antenna system 12 as appropriate, in a conventional manner. It will be apparent to those skilled in the art from this disclosure that the precise structure and algorithms for the controller 64 can be any combination of hardware and software that will carry out the functions of the present invention.

With regard to the mechanical driver 62, the rotatable support 24 can comprise any suitable type of arrangement that enables the mechanical driver 62 to rotate the rotatable support 24. For example, the rotatable support 24 can include a gear arrangement 66 that surrounds all or part of the rotatable support 24. The mechanical driver 62 can thus include a driving gear 68 that is configured to engage the gear arrangement 66 to rotate the rotatable support 24 about the rotation axis R. The mechanical driver 62 can comprise a manual driver 70, such as a handle, that enables manual rotation of the rotatable support 24 as can be understood by one skilled in the art. Alternatively or in addition, the mechanical driver 62 can comprise an automatic driver, such as a motor 72, that is controlled by, for example, the controller 64 or any other suitable control device, to enable automatic rotation of the rotatable support 24 as can be understood by one skilled in the art.

Figure 4:
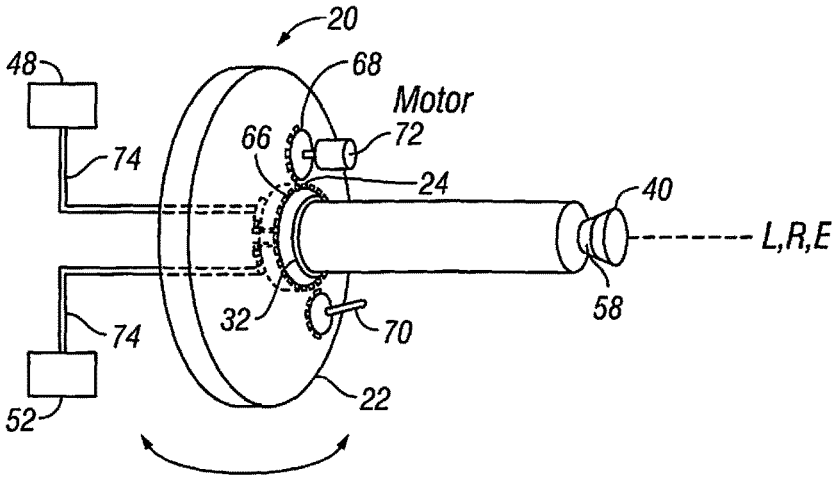
FIG. 4 is a diagram illustrating further details of another exemplary rotatable antenna feed structure as shown in FIGS. 1 and 2.
Figure 5:
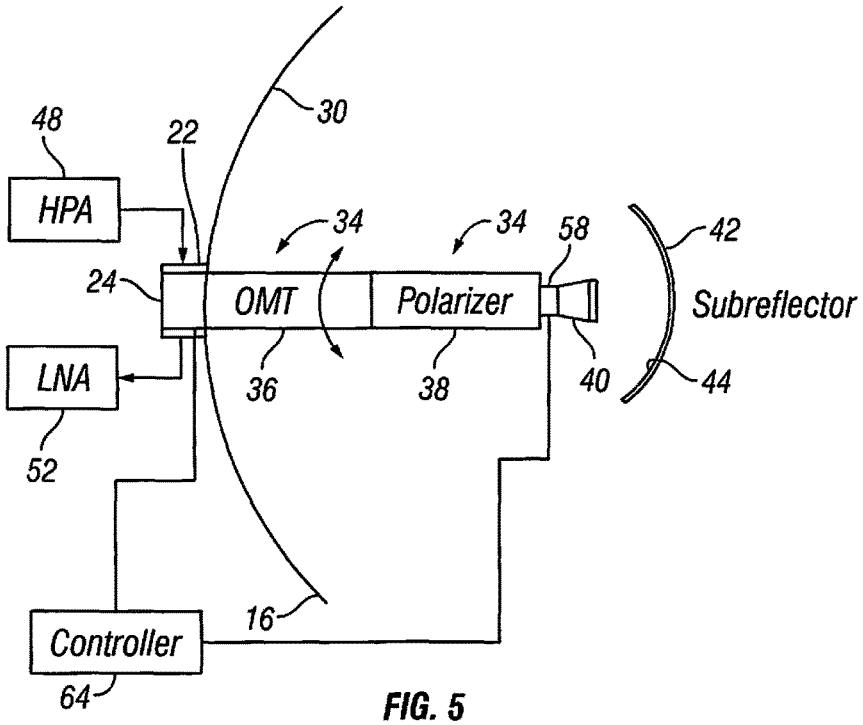
FIG. 5 is an electrical diagram illustrating exemplary components of a rotatable antenna feed structure.

Alternatively, as shown in FIG. 4, the components such as the high powered amplifiers 48, low noise amplifiers 52, non-flexible waveguides 56 and so on need not be mounted to the rotatable support 24. Rather, the rotatable support 24 can be configured, for example, to have a smaller diameter than that of the rotatable support 24 in the arrangement of FIG. 3. In this configuration, components such as the high powered amplifiers 48, low noise amplifiers 52 and so on can be mounted off of the rotatable support 24, such as in the antenna dish base 18, and coupled to the circularly polarized antenna feed by, for example, flexible waveguides 74 or in any other suitable manner. Thus, the circularly polarized antenna feed 34 can be rotated by the rotatable support 24 independently of the components such as the high powered amplifiers 48, low noise amplifiers 52 and so on.

An example of the installation and operation of the antenna system 12 will now be described with regard to FIGS. 1 through 5 as discussed above, as well as the graph in FIG. 6 and the flowchart in FIG. 7.

As understood by one skilled in the art, in a circularly polarized antenna feed, such as the circularly polarized antenna feed 34, a typical end-to-end link alignment angle generally cannot be assured between the gateway and satellite antenna feeds due to the inherent elliptical nature of the circular polarizers in the gateway and satellite antenna feeds. Thus, the alignment between the gateway and satellite antenna feeds typically results in an arbitrary alignment that may yield from a 3 dB average (power/10 log ratio) to a 6 dB (voltage/20 log ratio) or possibly more. Table 1 below shows an example in which the 0.4 Gateway (GW) TX AR source and the 0.6 dB AUT can yield from 24.8 to 27.6 dB on average.

TABLE 1

| GW TX AR | GW TX XPD | Sat RX XPD | Resulting Worse Case EtE XPD | Resulting Average EtE XPD |
|---|---|---|---|---|
| 0.4 | 32.8 | 29.2 | 24.8 | 27.6 |

However, by using the rotational features of the antenna system 12 as discussed herein to rotate the polarizer 38 by rotating the circularly polarized antenna feed 34, the end-to-end AR can be improved from, in this example, 24.8 dB to much greater than 30 to 35 dB in this example, thus resulting in minimizing the end to end XPD. In other words, by better aligning the ellipses, XPD is decreased and at least a 0.25 dB end-to-end link performance can be achieved, which amounts to at least a 2% to 3% improvement over the arbitrary alignment.

Figure 6:
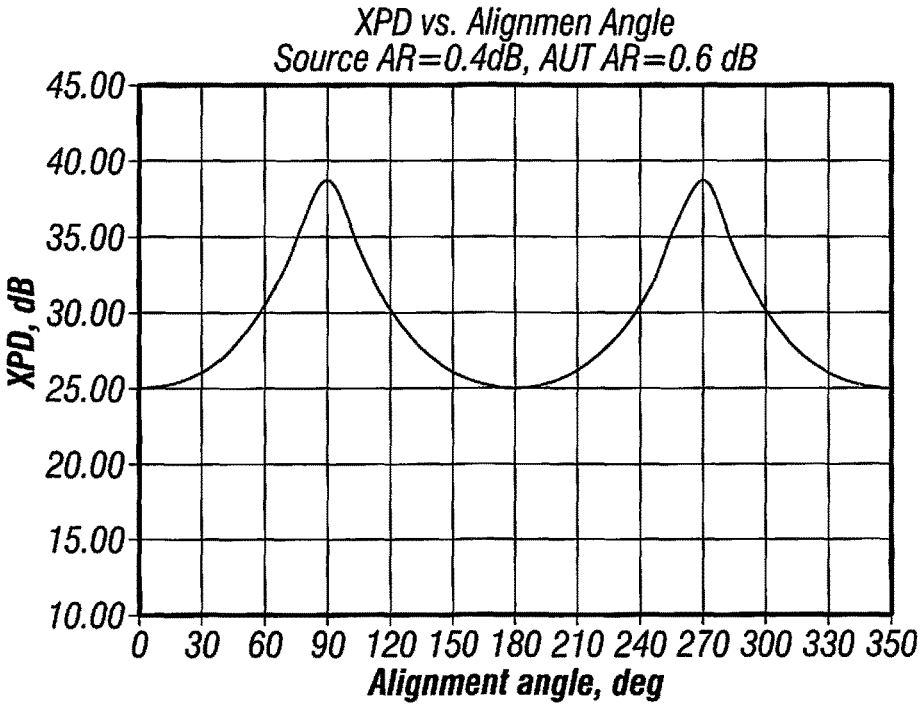
FIG. 6 is graph illustrating an example of an amount of cross-pol discrimination.

Thus, in an RF link where there is a transmitting circularly polarized antenna feed and a receiving circularly polarized antenna feed with an imperfect axial ratio, the resulting composite throughput cross-pol discrimination (XPD) can be minimized by providing the antenna system 12 at the gateway antenna 10 in this example to align or substantially align the ellipses of the transmitting circularly polarized antenna feed polarizer and the receiving circularly polarized antenna feed polarizer to minimize XPD as shown in the graph of FIG. 6. Although the antenna system 12 is discussed in this application as being disposed at the gateway antenna 10, the antenna system 12 having the features discussed herein can be employed in an orbiting satellite or at any other location in which an antenna of the type discussed herein is used.

Figure 7:
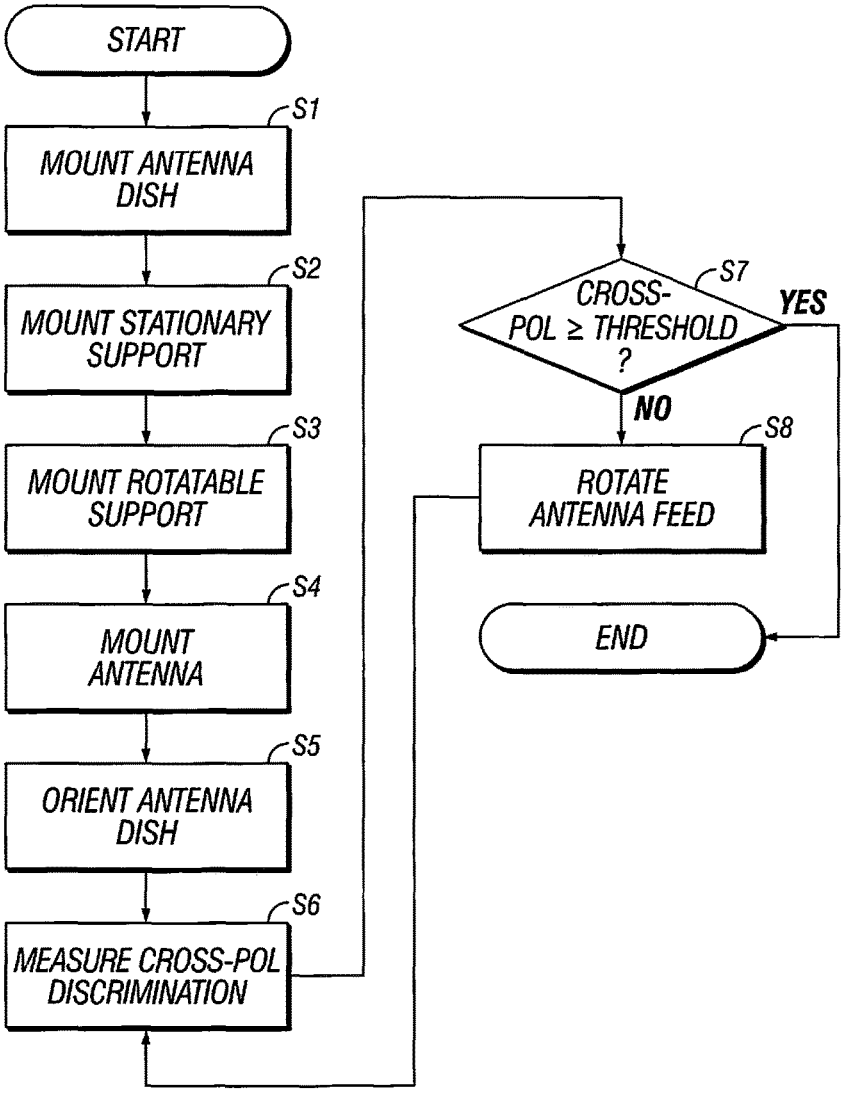
FIG. 7 is a flowchart illustrating exemplary operations associated with installing a gateway antenna dish according to a disclosed embodiment.

A shown in the flowchart of FIG. 7, during installation of a gateway antenna 10, the gateway antenna 10 is constructed by mounting an antenna dish 16 to a terrestrially mounted antenna dish base 18 associated with a gateway antenna equipment room 14 in any conventional manner in step S1. In step S2, the stationary support 22 is fixedly mounted with respect to the antenna dish 16. In step S3, the rotatable support 24 is rotatably mounted to the stationary support 22 in a manner as discussed above. As further discussed above, the rotatable support 24 comprises a first surface 26 and a second surface 28 opposite to the first surface 26, and the rotatable support 24 is rotatably mounted to the stationary support 22 to position the first surface 26 to face outward from the reflective surface 30 of the antenna dish 16. Also as discussed above, the first surface 26 has an antenna feed mounting structure 32 and the second surface 28 can have a high powered amplifier mounting structure 46 as shown in FIG. 3. Of course, the second surface 28 need not have a high powered amplifier mounting structure 46, or any of the other components discussed herein, mounted to the second surface 28 of the rotatable support 24.

In step S4, the circularly polarized antenna feed 34 is mounted to the antenna feed mounting structure 32 to extend outward along the longitudinal axis L of the circularly polarized antenna feed 34 with respect to the reflective surface 30 of the antenna dish 16. It should be noted that steps S2 and S3 can be performed before step S1, or steps S2 through S4 can be performed before step S1. Also, step S4 can be performed before steps S1 through S3. In other words, steps S1 through S4 can be performed in any practical order.

In step S5, an orientation of the antenna dish 16 is adjusted to position the circularly polarized antenna feed 34 in an alignment position with respect to a remote antenna. In step S6, cross-pol discrimination is measured at the circularly polarized antenna feed 34 in the alignment position to determine a measured amount of cross-pol discrimination. It is determined in step S7 whether the measured amount of end-to-end cross-pol discrimination (or simply "cross-pol discrimination" for purposes of this description) is at least equal to a predetermined threshold. The threshold can be, for example, 20 dB or any other suitable value. For instance, as can be appreciated from the graph in FIG. 6, it may be desirable for the end-to-end cross-pol discrimination to reach or at least come as close as possible to the maximum point of 37 dB in this example, which occurs at alignment angles of 90 degrees and 270 degrees in this example. If the measured amount of end-to-end cross-pol discrimination is at least equal to the predetermined threshold, the processing ends.

However, if the measured amount of end-to-end cross-pol discrimination is less than the predetermined threshold, the processing continues to step S8. In step S8, the rotatable support 24 is rotated with respect to the stationary support 22 about the rotation axis R that extends substantially parallel to the longitudinal axis L of the circularly polarized antenna feed 34. If the high powered amplifier 48 and other components are mounted to the rotatable support 24 as in FIG. 3, the rotation is performed while maintaining the circularly polarized antenna feed 34 and the high powered amplifier 48, as well as the other components mounted to the rotatable support 24, fixed with respect to each other to rotate in unison about the rotation axis R by at least one rotation interval. A rotation interval can be, for example, a few degrees (e.g., 1 degree) or any suitable number of degrees as understood in the art, or can be performed in a continuous manner manually or automatically (e.g., as controlled by controller 64) as cross-pol discrimination measurements are taken (e.g., manually or by the controller 64). Also, the rotation can be electrical rotation as performed by controlling the steerable antenna array 58 as discussed above. Naturally, the rotation can include any combination of mechanical and electrical rotation as discussed above.

The processing then returns to step S6 where the end-to-end cross-pol discrimination is measured with the circularly polarized antenna feed 34 having been rotated by this rotation interval. If it is then determined in step S7 the measured amount of end-to-end cross-pol discrimination is now equal to or greater than the predetermined threshold, the processing ends. However, if not, the processing returns to step S8 during which the circularly polarized antenna feed 34 is rotated, and steps S6 through S8 are repeated at each rotation interval to update the measured amount of end-to-end cross-pol discrimination at each rotation interval until the measured amount of end-to-end cross-pol discrimination is at least equal to the predetermined threshold. Thus, steps S6 through S8 are repeated while the measured amount of end-to-end cross-pol discrimination is less than a predetermined threshold.

As discussed above, the rotation can be mechanical, electrical, or both. Also, the rotation can be manual, automatic or both, and the measurement of the cross-pol discrimination can be performed manually, automatically, or both. For example, in a network using non-geostationary satellite orbit (NGSO) satellites, automatic rotation and measurement may be more effective, especially from a cost standpoint if adjustments need to be performed more frequently due to the nature of the non-geostationary satellite orbits.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also, the term "detect" as used herein to describe an operation or function carried out by a component, a section, a device or the like includes a component, a section, a device or the like that does not require physical detection, but rather includes determining, measuring, modeling, predicting or computing or the like to carry out the operation or function. The term "configured" as used herein to describe a component, section or part of a device includes hardware and/or software that is constructed and/or programmed to carry out the desired function. The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. An antenna system comprising:

a stationary support configured to fixedly mount to an antenna dish;

a rotatable support comprising a first surface, the rotatable support being rotatably mounted to the stationary support to position the first surface to face outward from a reflective surface of the antenna dish, the first surface having an antenna feed mounting structure configured to mount a circularly polarized antenna feed to extend outward along a longitudinal axis of the circularly polarized antenna feed with respect to the reflective surface of the antenna dish; and a driver configured to rotate the rotatable support with respect to the stationary support to rotate the circularly polarized antenna feed about the longitudinal axis.

2. The antenna system according to claim 1, wherein the driver is configured to rotate the rotatable support to rotate the circularly polarized antenna feed about the longitudinal axis to adjust alignment between the circularly polarized antenna feed and a remote antenna until cross-pol discrimination is at least equal to a predetermined threshold.

3. The antenna system according to claim 1, wherein the rotatable support comprises a gear arrangement; and the driver comprises a driving gear configured to engage the gear arrangement to rotate the rotatable support.

4. The antenna system according to claim 1, wherein the driver comprises a manual driver configured to enable manual rotation of the rotatable support.

5. The antenna system according to claim 1, wherein the driver comprises an automatic driver configured to enable automatic rotation of the rotatable support.

6. The antenna system according to claim 1, wherein the rotatable support comprises a second surface, opposite to the first surface, having an amplifier mounting structure configured to mount an amplifier fixed with respect to the circularly polarized antenna feed; and the driver is configured to rotate the rotatable support with respect to the stationary support while maintaining the circularly polarized antenna feed and the amplifier fixed with respect to each other to rotate in unison.

7. The antenna system according to claim 6, wherein the second surface further comprises a waveguide mounting structure configured to mount a non-flexible waveguide coupled between the circularly polarized antenna feed and the amplifier such that the non-flexible waveguide remains undeformed as the rotatable support rotates with respect to the stationary support.

8. The antenna system according to claim 1, further comprising a steerable antenna array configured to mount to the circularly polarized antenna feed; and a controller configured to control the steerable antenna array to electrically steer the circularly polarized antenna feed about an electrical rotation axis.

9. A method for installing an antenna system comprising:

mounting a circularly polarized antenna feed support structure to an antenna dish, the circularly polarized antenna feed support structure comprising a stationary support configured to fixedly mount to the antenna dish and a rotatable support rotatably mounted to the stationary support to position a first surface of the rotatable support to face outward from a reflective surface of the antenna dish, the first surface having an antenna feed mounting structure;

mounting to the antenna feed mounting structure a circularly polarized antenna feed to extend outward along a longitudinal axis of the circularly polarized antenna feed with respect to the reflective surface of the antenna dish;

adjusting an orientation of the antenna dish to position the circularly polarized antenna feed in an alignment position with respect to a remote antenna;

measuring cross-pol discrimination at the circularly polarized antenna feed in the alignment position during communication between the circularly polarized antenna feed and the remote antenna to determine a measured amount of cross-pol discrimination; and while the cross-pol discrimination is less than a predetermined threshold, rotating the rotatable support with respect to the stationary support to rotate the circularly polarized antenna feed to adjust alignment between the circularly polarized antenna feed and the remote antenna until the cross-pol discrimination is at least equal to the predetermined threshold.

10. The method according to claim 9, further comprising mounting a steerable antenna array to the circularly polarized antenna feed; and controlling the steerable antenna array to electrically rotate the circularly polarized antenna feed to adjust electrical alignment between the circularly polarized antenna feed and the remote antenna.

11. The method according to claim 9, further comprising before performing the adjusting, measuring and rotating, mounting an amplifier to a second surface of the rotatable support, opposite to the first surface, such that the amplifier is fixed with respect to the circularly polarized antenna feed; and wherein the rotating is performed while maintaining the circularly polarized antenna feed and the amplifier fixed with respect to each other to rotate in unison.

12. The method according to claim 11, further comprising before performing the adjusting, measuring and rotating, mounting a non-flexible waveguide coupled between the circularly polarized antenna feed and the amplifier; and wherein the rotating is performed while maintaining the non-flexible waveguide undeformed as the rotatable support rotates with respect to the stationary support.

13. The method according to claim 9, wherein the rotating includes manually rotating the rotatable support.

14. The method according to claim 9, wherein the rotating includes automatically rotating the rotatable support.

15. An antenna system comprising:

a stationary support configured to fixedly mount to an antenna dish;

a rotatable support mounted to the stationary support and including an antenna feed support configured to mount a circularly polarized antenna feed to the antenna dish to extend outward along a longitudinal axis of the circularly polarized antenna feed with respect to a reflective surface of the antenna dish; and a driver configured to rotate the circularly polarized antenna feed to adjust alignment between the circularly polarized antenna feed and a remote antenna.

16. The antenna system according to claim 15, further comprising the driver is configured to rotate the rotatable support to rotate the circularly polarized antenna feed to adjust alignment between the circularly polarized antenna feed and the remote antenna until cross-pol discrimination is at least equal to a predetermined threshold.

17. The antenna system according to claim 15, wherein the rotatable support is rotatably mounted with respect to the antenna dish; and the driver is configured to mechanically rotate the rotatable support to rotate the circularly polarized antenna feed.

18. The antenna system according to claim 17, wherein the rotatable support comprises a gear arrangement; and the driver comprises a driving gear configured to engage the gear arrangement to rotate the rotatable support.

19. The antenna system according to claim 15, further comprising a steerable antenna array configured to mount to the circularly polarized antenna feed; and the driver comprises a controller configured to control the steerable antenna array to electrically rotate the circularly polarized antenna feed to adjust electrical alignment between the circularly polarized antenna feed and a remote antenna.

20. The antenna system according to claim 19, wherein the rotatable support is rotatably mounted with respect to the antenna dish; and the driver is configured to mechanically rotate the rotatable support to rotate the circularly polarized antenna feed.

* * * * *